US006916404B2

(12) United States Patent
Komulainen et al.

(10) Patent No.: US 6,916,404 B2
(45) Date of Patent: Jul. 12, 2005

(54) METHOD AND APPARATUS FOR WEB THREADING IN A DRYING SECTION OF A PAPER MACHINE OR SIMILAR

(75) Inventors: Antti Komulainen, Keuruu (FI); Kari Juppi, Palokka (FI); Jorma Laapotti, Palokka (FI); Reijo Jokinen, Raisio (FI); Matti Kurki, Jyväskylä (FI); Juha Lipponen, Kerava (FI); Markku Lyytinen, Jyväskylä (FI); Samppa J. Salminen, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 55 days.

(21) Appl. No.: 10/381,672

(22) PCT Filed: Oct. 26, 2001

(86) PCT No.: PCT/FI01/00925

§ 371 (c)(1),
(2), (4) Date: Apr. 16, 2003

(87) PCT Pub. No.: WO02/35001

PCT Pub. Date: May 2, 2002

(65) Prior Publication Data

US 2004/0035539 A1 Feb. 26, 2004

(30) Foreign Application Priority Data

Oct. 27, 2000 (FI) ..... 20002358

(51) Int. Cl.[7] ..... D21F 1/36; D21F 5/04; F26B 11/02

(52) U.S. Cl. ..... 162/193; 162/194; 162/286; 162/366; 162/375; 34/117; 34/120; 226/92

(58) Field of Search ..... 162/120, 193–195, 162/206, 207, 286, 255, 260, 363–375; 226/91, 92; 34/113–123, 454–458; 83/23–28, 53, 56, 614

(56) References Cited

U.S. PATENT DOCUMENTS

| | | | | | |
|---|---|---|---|---|---|
| 2,857,822 | A | | 10/1958 | Heys | |
| 4,932,138 | A | * | 6/1990 | Liedes et al. | 34/456 |
| 5,019,213 | A | * | 5/1991 | Virta et al. | 162/193 |
| 5,037,509 | A | | 8/1991 | Wedel | |
| 5,371,954 | A | | 12/1994 | Pinter et al. | |
| 5,600,897 | A | * | 2/1997 | Sollinger et al. | 34/115 |
| 5,873,180 | A | * | 2/1999 | Grunder | 34/117 |
| 5,974,684 | A | | 11/1999 | Steiner et al. | |

FOREIGN PATENT DOCUMENTS

| | | | | |
|---|---|---|---|---|
| DE | 44 40 948 A1 | | 5/1996 | |
| EP | 0 584 492 A1 | | 3/1994 | |
| EP | 0 584 492 B1 | | 3/1994 | |
| EP | 0 584 492 | * | 3/1994 | D21G/9/00 |

* cited by examiner

*Primary Examiner*—Eric Hug
(74) *Attorney, Agent, or Firm*—Oliff & Berridge, PLC

(57) ABSTRACT

A method and an apparatus for web threading in a drying section of a paper machine or the like. A leader (24) and a so called run-down strip are formed by cutting in the web coming to the drying cylinder in the drying section. An underpressure box (18) is arranged at the opening gap between the drying cylinder (14) and the drying wire, on that side of the wire which is away from the web, whereby this box can direct against the web an underpressure which is controllable in the machine's cross direction. The underpressure box creates an underpressure region (34') between the leader and the underpressure box, the region having an underpressure $p_1$ at the detachment point, i.e. in the area where the wire is detached from said drying cylinder (14), which underpressure is sufficient to detach the leader from said drying cylinder. A protection zone is created between the underpressure region created at the leader and the run-down strip, which protection zone has a barrier (46) in order to maintain the underpressure $p_1$ in the underpressure region.

19 Claims, 9 Drawing Sheets

METHOD AND APPARATUS FOR WEB THREADING IN A DRYING SECTION OF A PAPER MACHINE OR SIMILAR

The present invention relates to a method and an apparatus defined in the preambles of the independent claims presented below for web threading in a drying section of a paper machine or the like.

In modern machines for paper or board the web is conveyed from the press section to the drying section, typically as a closed run without any open run, so that the web is transferred in full width up to the first drying cylinder of the drying section. The first drying cylinder of the drying section is typically adapted for a so called single wire run.

It is also possible to convey the web to the first drying cylinder as a narrow band, which is allowed to widen to the full width on the drying cylinder. This is usually the case in paper machines, which have a press of a conventional type, and which have an open run from the press to the drying section. Between the press section and the first drying cylinder there can be other devices, for instance a top blow unit or some other drying unit. From the drying cylinder the web is typically allowed to run via a doctor into a pulper below the machine, or to the broke conveyor or the like located below the machine.

When the full width web has arrived at the first drying cylinder, then at first only a narrow band, the so called leader, is passed forward to the end of the drying section. Then the leader is arranged at least partly to follow the wire onward in the drying section. When the tail end of the web has been successfully transferred to the end of the drying section, or to the end of a desired part of the drying section, then the leader is widened, in the so called spreading phase of the threading, into the full width of the web, in order to transfer the full-width web through the drying section or trough the desired part of it.

In the following "web threading" means, if not otherwise stated, both the initial phase of the treading, where only a narrow leader is transferred through the drying section or the like, and the spreading phase of the threading, where the narrow leader is widened to a full-width web.

The web is typically transferred forward in the drying section utilising a separate narrow first strip, a leader, formed by cutting in the edge of the web, so that the leader as the first tail is conveyed onward through the drying section. The rest of the web form a second strip, an almost full-width, so called run-down strip, which in the initial phase is not conveyed to the drying section, but which is run from the doctor blade at the first drying cylinder down to a pulper below the machine, or to a broke conveyor or the like located below the machine.

A suitable detachment of the different parts of the web from the drying cylinder, both during web threading and during a normal run, is slightly problematic. During normal run the web should come off the drying cylinder over its whole width, and immediately in the opening gap between the cylinder and the wire. However, during web threading only the narrow leader or the widening leader should come off the cylinder, whereas the rest of the web, at first the main part of the web, should stay attached to the cylinder's surface along a certain distance, also after the opening gap.

The web threading from the first cylinder and onwards can thus be particularly problematic when running at high speeds, e.g. over 1500 m/min. Then the edge of the run-down strip closest to the leader will easily follow the wire forward in the drying section, as the actions on the leader will also act at this edge.

In order to enable the web threading from the first drying cylinder and further with the aid of the leader, the above mentioned second strip, or the main part of the web, must be prevented from following the wire too early and from causing problems in the drying section, such as a too high amount of broke accumulating in the basement of the drying section. Thus the main part of the web must be made to stay in a controlled manner during the web threading on the surface of the first drying cylinder, also in the opening gap between the cylinder and the wire.

The web coming from the press section will easily come off the surface of the first drying cylinder, as it has not been possible to attach the web to it in a proper manner, for instance with the aid of nip, as is made in the press section where the web is attached to the surface of a smooth roll with the aid of a nip. If the web would be too strongly attached to the surface of the drying cylinder that would cause problems in detaching the web, when it is finally desired to detach it from the drying cylinder.

For the drying sections there have been developed bulky blow/underpressure boxes, which create a strong underpressure and which make during normal run the web to follow the drying wire in a controlled manner after the opening gap between the drying cylinder and the wire, also when running at high speeds. With these boxes it is possible to secure that the narrow actual leader and the widening part of the web during the spreading phase will reliably follow the drying wire. There must be no breaks of the leader or of the spreading web, so the web transfer must occur in a controlled manner. As these underpressure boxes maintain a very strong underpressure the run-down strip part may even in the web threading phase tend to follow the wire instead of following the first drying cylinder in a controlled manner and falling down only at the cylinder's doctor blade to the pulper or the like below the machine.

The object of the present invention is to provide an improved method and apparatus for web threading in a paper machine or the like.

An object of the invention is to provide a method and apparatus with which the above mentioned problems are minimized.

A particular objective of the invention is to provide a method and apparatus which can secure a controlled transfer of the leader through the drying section.

A further object is to provide a method and apparatus which can prevent the rundown strip part of the web from travelling onwards in the drying section in a non-controlled manner.

An object is further to provide a method and apparatus which in a controlled manner can separate the leader and the run-down strip from each other and make them travel in controlled manner at the opening gap of the first drying cylinder, and also thereafter.

In order to attain the above mentioned objects the method and the apparatus according to the invention are characterised by what is defined in the characterising parts of the independent claims presented below.

The invention can be very advantageously applied in a cylinder drying section where at least the first cylinder drying group is a group which is adapted for a so called single wire run where an underpressure box is arranged at the opening gap between the first drying cylinder and the drying wire, i.e. in the region where the drying wire is detached from the drying cylinder, on that side of the wire which is away from the web, whereby this box can direct an underpressure against the web at the detachment point, i.e. in the region where the drying cylinder and the wire are detached. The underpressure can be created for instance through the action of ejection blows or suction. In the solution according to the invention the underpressure box can advantageously create an underpressure, which can be controlled in the machine's cross direction. Thus the underpressure box can on one hand create at the leader an underpressure region, whose underpressure $p_1$ is sufficient to detach the leader from the first drying cylinder and/or to aid the leader to follow the wire, and on the other hand it can create against the rest of the web a lesser underpressure $p_2$, which can be an underpressure, a zero pressure or an overpressure, which allows this rest of the web to come off the drying wire and to follow the drying cylinder up to the doctor blade. At the detachment point the underpressure $p_1$ is during the web threading generally between 300 and 10000 Pa, typically 500 to 5000 Pa, most typically between 600 and 3000 Pa. At the same time the pressure $p_2$ is generally between 300 Pa underpressure and 10000 overpressure, typically between 100 Pa underpressure and 5000 Pa overpressure, most typically between 50 Pa underpressure and 500 Pa overpressure. In the travel direction of the web, after the detachment point there is generally arranged between the web and the underpressure box an underpressure, which is substantially lesser than said underpressure $p_1$, i.e. an underpressure between about 50 and 500 Pa, typically an underpressure between 100 and 400 Pa, an underpressure most typically between 200 and 400 Pa.

The solution according to the invention can typically utilise an actual underpressure box to create a desired underpressure at the leader and/or at one or more other strips. On the other hand the solution according to the invention can be utilised also when the underpressure is created by some other suitable apparatus. The invention can be applied also when the underpressure is created only at the leader, but not at other strips.

In the solution according to the invention it has been further proposed to create a protection zone between the region with underpressure and the second region with the lesser underpressure, so that the zone has a barrier which makes it possible to maintain a stronger underpressure $p_1$ in the underpressure region at the leader than in the region at the run-down strip. The object of the protection zone is to create a removal of the underpressure as rapidly as possible after the leader in the machine cross direction. In this way the aim is to prevent the rest of the web, i.e. the main portion of the web, from becoming subject to the underpressure.

Further, a third narrow strip is preferably formed in the web at the protection zone between the leader and the second strip. Then a barrier can be placed at the region of the third strip, whereby a change in the underpressure between the underpressure box and the web will occur in the region of this third strip, and this change will not hinder the onward travel of the leader, nor the running down of the main part of the web from the drying section.

Instead of the third strip the leader and the second strip can be separated from each other by a slit, which is broader than usual, and the barrier can be arranged at this slit. By using a particularly effective barrier it is also in this case possible to avoid problems caused by the pressure changes at the leader and the second strip. The cutting of a full-width web into a first, a second and a third strip is typically made immediately before the first drying cylinder, but it can also be made substantially earlier before this cylinder, or even not until on the cylinder.

According to the invention there can be used many different solutions to create a barrier around the underpressure region in the machine cross direction. The barrier can be provided by sealing members which extend from the underpressure box toward the web, or by means which create ejecting blows. These means are preferably movable in the machine cross direction, whereby the barrier can be moved in the machine cross direction, and thus it also operates in connection with the spreading of the leader.

When the leader is formed at the edge of a full-width web the barrier according to the invention is generally needed only at that side of the leader which is away from the machine's edge. Whereas, if the leader on the other hand is formed in the middle of a full-width web, then barriers according to the invention are generally needed on both sides of the leader, in order to separate the run-down strips, or the so called second strips, on both sides of the leader.

In a typical drying section utilising the solution according to the invention there is arranged such cutting members, which in addition to the first so called leader and the second so called run-down strip can form a third strip between said first and second strips by cutting from the full-width web coming from the press section. Thus a third strip is cut from the web between the first and second strips. The cutting members can be blades, water jets or gas jets, or some other members, which can make slits in the web, or which in some other way can divide the web into longitudinal portions.

The third strip is a very narrow strip, having a width of preferably <500 mm, typically 3 to 400 mm, most typically 5 to 300 mm, which can be run down into a pulper or the like below the machine, or which can be allowed to exit some other route. Typically the third strip is narrower than the leader, and so narrow and light that it will not cause any bigger problem when it is "flying" to the pulper or when it is transferred a distance further in the drying section, but that it can be easily removed.

In addition the third strip can be cut into extremely narrow fine strips, when desired, whereby this secures better than previously that this part of the web does not create problems in the drying section or elsewhere. Advantageously the fine strips are made so narrow that they easily break, and thus they do not cause large paper lumps in the pockets of the machine. Narrow fine strips can be easily blown away from the drying section.

Advantageously the third strip is made so wide that it is possible to decrease the underpressure mainly over the range of this strip from the underpressure $p_1$ prevailing at the leader to the pressure $p_2$ prevailing at the second strip. If the pressure can be changed very abruptly i.e. over a very short distance in the machine cross direction, such as over a wide slit, for instance with suitable barrier members, then no third strip is necessarily required at all. A wide slit can be made for instance with two or more cutters arranged side by side or one after another in an overlapping manner.

In a typical solution according to the invention the underpressure of the underpressure box arranged at the gap opening towards the wire run after the first drying cylinder can be controlled in the machine cross direction. A strong underpressure $p_1$ is arranged at the leader, which underpressure assists in making the leader to follow the drying wire after the opening gap, and at the second strip, i.e. the "run-down" strip, there is arranged an underpressure $p_2$, which is lesser than said underpressure $p_1$. Due to the mentioned pressure differences, $p_1$ and $p_2$, the pressure will change between the strips, i.e. at the protection zone according to the invention. The width of the required protection zone, for instance the third strip, depends on the barrier arrangements, with which the pressures $p_1$ and $p_2$ are separated from each other. The pressure state created at the protection zone can also be controlled, when desired. In the spreading phase the synchronisation of the widening of the cutting and of the underpressure $p_1$ will contribute to the required width of the protection zone.

It is well known to bound the narrow underpressure region formed between the underpressure box and the drying cylinder in the incoming direction of the wire from the other space by ejection blows, with which air is discharged from the underpressure region and which at the same time prevent air from being sucked from the surrounding space, or air from passing together with the wire to the underpressure region. At the application of the solution according to the invention these ejection blows can be disturbed locally during the web threading, for instance at the second and third strips, so that the underpressure acting on the web at these points will decrease.

When required, it is possible to arrange members at the second and/or third strip, which members during web threading actively can prevent these strips from following the drying wire after the first drying cylinder. The members can for instance comprise blowing members, having blows which prevent these strips from following the wire or which detach these strips from the wire.

The desired travel of the leader in the gap between the drying cylinder and the drying wire can be further secured by suitably wetting this strip, i.e. so that its attachment to the drying wire is improved. On the other hand, the detachment of the leader from the drying cylinder can also be secured by spraying at suitable spots on the web or on the cylinder different substances known as such, which aid the detachment, for instance substances containing silicone. In a corresponding way we can secure that the run-down strip, i.e. the main portion of the web, is detached from the drying wire and attached to the surface of the drying cylinder by fastening this portion of the web to the surface of the drying cylinder, using applicable substances known as such. It is possible for instance to spray the surface of the web or the cylinder with substances which improve the attachment of the web to the surface of the cylinder.

This invention is applicable also when only the leader of the web is transferred over the drying cylinder in order to convey it further in the drying section, and the rest of the web is allowed to leave the drying section and pass into a pulper or the like already before the drying cylinder. The barriers are able to seal the underpressure region at the leader from the surrounding regions.

In this application the first drying cylinder means, if not otherwise stated, the first drying cylinder of the drying section in question, thus not necessarily the very first drying cylinder of the drying section or the drying cylinder group. Thus the invention can be applied even within a drying cylinder group, for instance in the region between the fourth and the fifth drying cylinders.

The invention is described in more detail below with reference to the enclosed drawings, in which FIG. 1 shows schematically from one side the first drying cylinder group in a paper machine where the invention is applied;

FIG. 2*a* shows schematically from above a full-width paper web where a slit is made in a known way in order to create a leader;

FIGS. 2*b* to 2*e* show in accordance with FIG. 2*a* a full-width web, where slits are made according to the invention in order to create a leader;

FIG. 3*a* shows schematically from one side the top end of the underpressure box, where a protection zone provided with a barrier according to the invention is arranged at the suction opening;

FIG. 3*b* shows a strip-like control member for the suction opening to be used in the solution according to FIG. 3*a*, seen obliquely from above;

FIG. 4*a* shows the top end of another underpressure box applying the invention in accordance with FIG. 3*a;*

FIGS. 4*b* to 4*f* show schematically aperture plates arranged in different positions in the suction channel of the underpressure box shown in FIG. 4*a;*

FIG. 5*a* shows schematically a horizontal cross-section of an underpressure box where the invention is applied, whereby the box extends across the web and whereby it is provided with underpressure control;

FIG. 5*b* shows an enlargement of the barrier member presented in FIG. 5*a;*

FIG. 6*a* shows schematically and seen from one side of the web an underpressure box where the inventive solution is applied, whereby the box is arranged at the opening gap between the drying cylinder and the wire, and where preventing blow means are arranged for a controlled guiding of the run-down paper;

FIG. 6*b* shows a cross-section along the line AA in FIG. 6*a;*

Figure 9A:
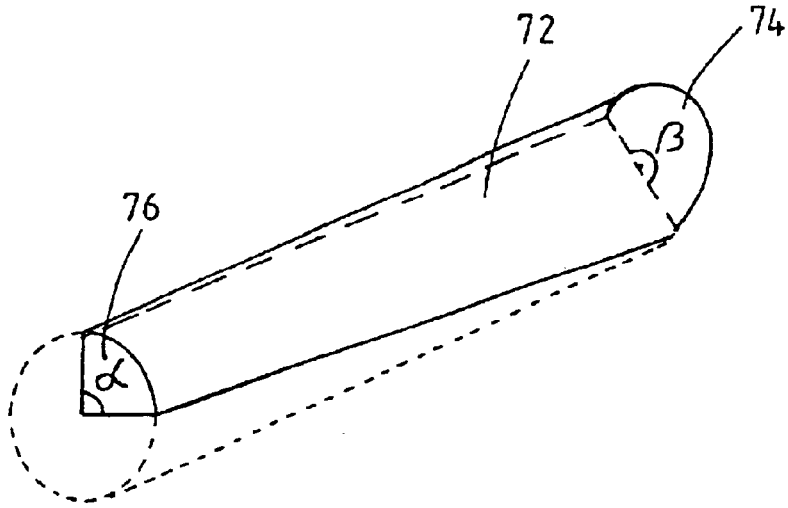
Figure 9B:
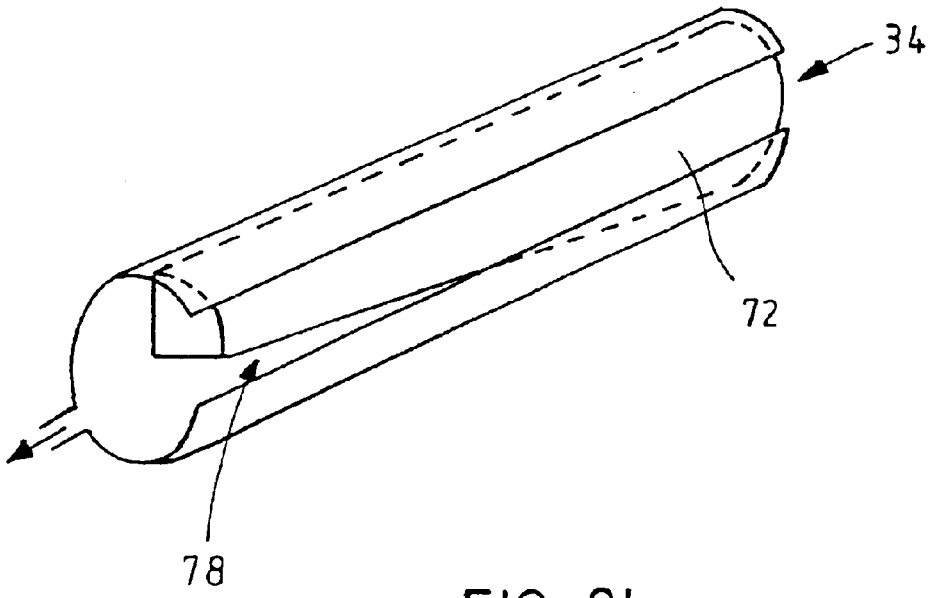

FIG. 9*a* shows schematically and obliquely from above a member, which controls the opening of the suction opening and which is mounted in the suction opening of an underpressure box where the invention is applied;

FIG. 9*b* shows schematically the member according to FIG. 9*a* mounted in front of the suction opening; and FIGS. 10*a–f* show cross-sections of the member in FIG. 9*a* on the machine's front side and back side.

Figure 1:
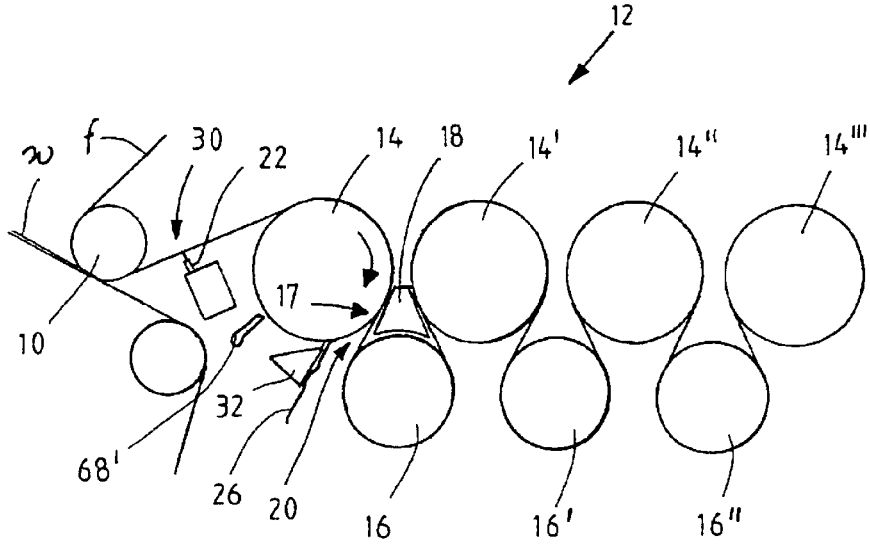

FIG. 1 shows a first drying cylinder group where the invention is applied in a drying section provided with a single wire run. However, the invention can also be applied in other places of the cylinder group, in other drying cylinder groups, and even in drying sections of other types.

In the case of FIG. 1 the web w to be dried is transferred by the transfer suction roll 10 to the drying wire F of the drying cylinder group 12, where the wire guides the web over the first drying cylinder 14 and further over the first suction roll 16 to the next drying cylinder 14', and so on over the next suction rolls 16', 16" and drying cylinders 14", 14'", up to the end of the drying group. Instead of the suction rolls the drying group can use other means known as such in order to guide the web, which supported by the wire is transferred over the runs between the drying cylinders.

An underpressure box 18 is arranged in the pocket formed by the drying cylinders 14 and 14' and the suction roll 16 in order to transfer the web to be dried during the run in a way known as such in the opening gap 20 between the first drying cylinder 14 and the drying wire F, so that the web follows the drying wire in a controlled manner to the suction roll 16. Corresponding underpressure boxes may be located also in the pockets between other drying cylinders and suction rolls, even if such are not shown here.

After a shutdown, or after a web break, a new web is brought in full width from the transfer suction roll 10 to the drying wire F, with which the full-width web is transferred over the first drying cylinder 14. After the opening gap 20 between the drying cylinder and the drying wire F the wire is first allowed to transfer only a narrow strip, a so called leader shown e.g. in FIG. 2*b*, through the drying group 24.

Figure 2E:
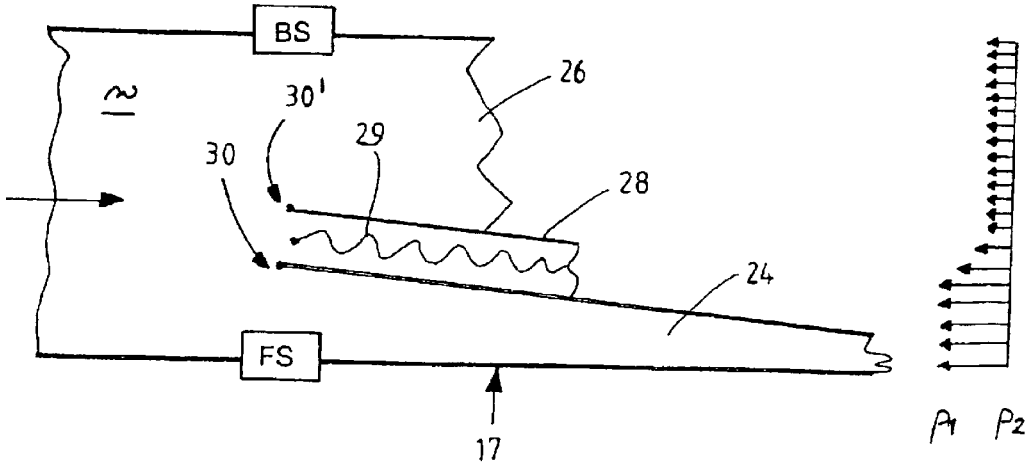
Figure 2A:
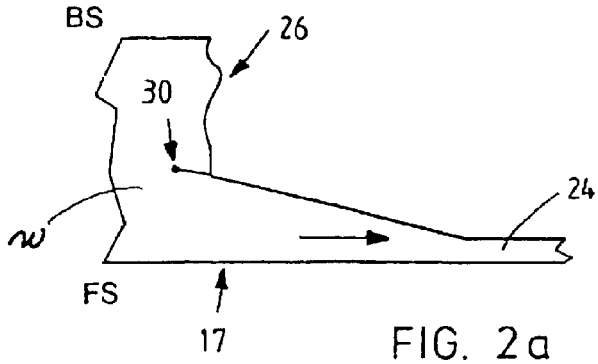
Figure 2B:
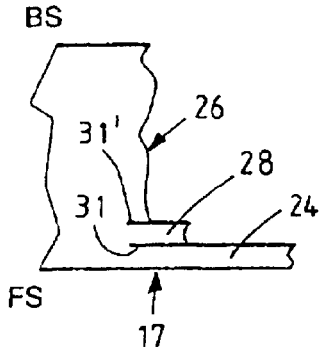
Figure 2C:
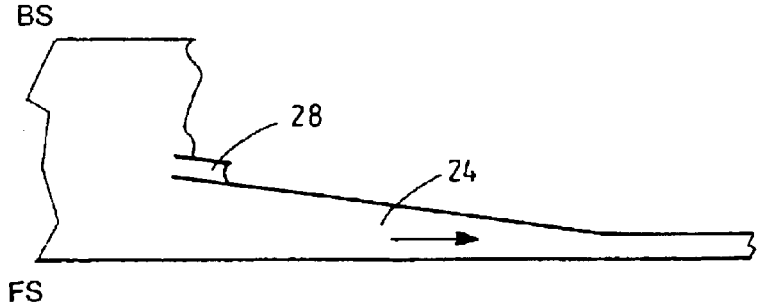

When the leader passes through the whole drying group or drying section in a controlled manner, then the spreading of the leader to the full width of the web is commenced, as shown in FIG. 2*c*.

From the full-width web coming from the transfer suction roll 10 the leader is formed by cutting, in the case of FIG. 1 with an angle cutter 22. The cutter can be any type of device suitable for cutting the web, such as a steel cutter or a cut squirt cutting with the aid of a water jet. In the case of FIG. 1 the cutting is made after the transfer suction roll 10 at point 30 before the drying cylinder. However, the cutting can be arranged to occur also earlier, i.e. before the transfer suction roll, or later, for instance at the first drying cylinder 14.

FIG. 2*a* shows schematically the web w seen from above at the cutting point 30, and a distance further after that. One cut at the cutting point 30 creates from the web in a conventional way a narrow leader or web threading strip 24, and a second strip 26, the so called run-down strip. Generally the leader is made on the front side (FS) of the machine. The run-down strip extends usually from the leader up to the machine's back side (BS). The leader 24 is guided to travel, for instance in the case of FIG. 1, from the first drying cylinder and onward in the drying section. The second strip 26 is allowed to leave the drying cylinder's doctor blade 32 to a pulper or the like below the drying section. The FIG. 2*a* shows a step where the spreading of the leader 24 has just begun.

According to one typical embodiment of the invention, presented in FIG. 2*b*, it is proposed that the web is cut at 30 by two slits 31 and 31', so that the web forms a narrow third strip, a so called intermediate strip 28, between the leader 24 and the run-down portion 26 of the web, and the protection zone according to the invention is formed at this third strip. This third strip 28 is transferred together with the spreading of the leader 24 towards the back side of the machine, as shown in FIG. 2*c*. The width of the third strip is advantageously <500 mm, typically 5–300 mm. The width of the third strip can be adjusted by changing the distance between the cut squirts or blades. Usually it is recommended to make the third strip as narrow as possible, as the strip then causes least troubles later on.

In the case of the FIGS. 2*b* and 2*c* all three strips 24, 26 and 28 will follow the wire F into the opening gap 20 between the drying cylinder 14 and the wire F, up to the disengagement point 17 shown in FIG. 1 where the wire is detached from the drying cylinder. After this disengagement region only the leader 24 will follow the wire, and the second or run-down strip 26 is removed via the doctor blade 32 to a space below the machine. The narrow third strip 28 can be removed from the drying section at the same time or at a later point, for instance also to the pulper below the machine.

Figure 2D:
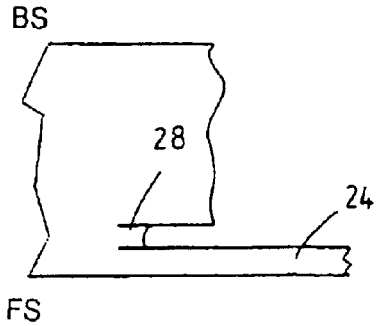

According to the second embodiment presented in FIG. 2*d* the third strip 28 can be removed from between the strips 24 and 26 immediately after the cutting, i.e. even before the drying cylinder.

FIG. 2*e* shows in the same manner as FIG. 2*b*, but on a larger scale, how the full-width web w is cut into three strips, the leader 24, the second or run-down strip 26, and the third or intermediate strip 28, which in addition has been cut in a zigzag cutting 29 by a cut squirt or in some other suitable manner into two narrow fine strips in order to facilitate the removal of the intermediate strip. When desired, the intermediate strip can of course be cut into even a plurality of fine strips. The protection zone according to the invention is formed at the finely cut intermediate strip 28. The cutting point 30 is located for instance in front of the first drying cylinder at the location shown in FIG. 1.

For instance in the case of FIG. 2*e* it is possible to form instead of the cuttings 29, 30, 30', which form the intermediate strip or strips, a particularly wide slit at the intermediate strip, where the protection zone according to the invention is formed.

Thus the solution according to the invention can be applied also in a situation where no real third strip is formed, but where the cutting is made so that it creates a wide slit, at the location of which it is possible to create the protection zone according to the invention. Then the cutting is performed by a number of cut squirts or a blade, which are typically arranged side by side. A wide slit can be created also by a number of cut squirts or blades, which are located one after another in an interleaved fashion. In a cutting like this the created paper scrap is removed as typical cutting waste immediately at the cutting point. Advantageously the width of the slit is >2 mm, typically at least 4 mm. In principle the wide slit can be formed in the web already in the wire section or press section.

If it is desired to form the leader centrally in the web, then so called third strips can be formed on both sides of this leader in order to separate the leader from the rundown strips formed at the edge of the web.

At the opening gap 20 shown in FIG. 1, at the so called disengagement point 17, the underpressure box 18 directs a strong underpressure $p_1$ at the leader 24, which is created on the machine's front side and shown for instance in the FIG. 2*e*. The underpressure keeps the leader 24 attached to the drying wire F, and this makes the leader to travel forward in the drying section. The underpressure of the underpressure box is allowed to decrease at the intermediate strip 28, in the direction from the front side toward the back side (BS), so that the underpressure at the second strip 26 is lowered to a pressure $p_2$, which can be an underpressure, a zero pressure i.e. the atmospheric pressure, or even an overpressure. The pressure $p_2$ is chosen so that this pressure allows the second strip to be detached from the wire F in a controlled manner at the opening gap 20. The second strip 26 is typically arranged to follow the drying cylinder 14 up to its doctor blade 32, from where the web can flow downwards under the machine.

The right-hand side of the FIG. 2*e* illustrates with the aid of pressure curve arrows the different underpressure levels/pressure levels p at the detachment point 17 of the underpressure box, in the machine cross direction, during web threading. FIG. 2*e* shows that the underpressure $p_1$ over the leader 24 is stronger than the underpressure $p_2$ over the second strip. In other applications of the invention the pressure $p_2$ can be an underpressure, a zero pressure or an overpressure. The FIG. 2*e* shows further that the underpressure level p changes at the third strip 28.

The decreasing underpressure over the third intermediate strip 28 results in that this narrow intermediate strip 28 can come off the wire, and for instance together with the run-down web it can pass out into a pulper below the machine, or it can travel a short distance further in the drying section, for instance over one or two drying cylinders, without causing problems in the web threading. The third strip is so narrow that it will break easily, and thus it can be easily removed from the drying section. The underpressure is reduced at the third strip, typically from its maximum value to its minimum value. The spreading phase of the web threading is already begun in the case shown in FIG. 2*e*. The leader 24 is wider at the cutting point 30, 30' than that part of the leader strip, which has advanced farther away into the drying section.

In this typical solution according to the invention the underpressure level of the underpressure box can be controlled in the machine cross direction, so that the area where the underpressure box creates the high underpressure level $p_1$ increases in the cross direction during web spreading, mainly as the first strip 24 is widened. Thus the underpressure box advantageously creates a strong underpressure over the whole widening leader. Correspondingly the pressure level of the underpressure box is kept on the level $p_2$ mainly only over the run-down strip.

The use of the third strip according to the invention, the intermediate strip, facilitates the arrangement of an optimal underpressure region both over the region of the leader and over the region of the run-down strip. For the underpressure control and the separation of regions with different underpressures from each other there are different solutions, which are described below. A change in the underpressure region can also be synchronized in different ways with the cutting of the leader.

In FIG. 1 the invention has been applied at the beginning of a cylinder drying group which is located at the beginning of the drying section, immediately after the press section. The solution according to the invention can be used also elsewhere, such as in different cylinder drying groups or in cylinder drying groups arranged elsewhere in the drying section, in drying sections comprising in addition to the cylinder drying groups also other drying sections, or in another location of the cylinder drying group. The invention is typically applied at a drying cylinder, from which the web can be run downwards.

Figure 3A:
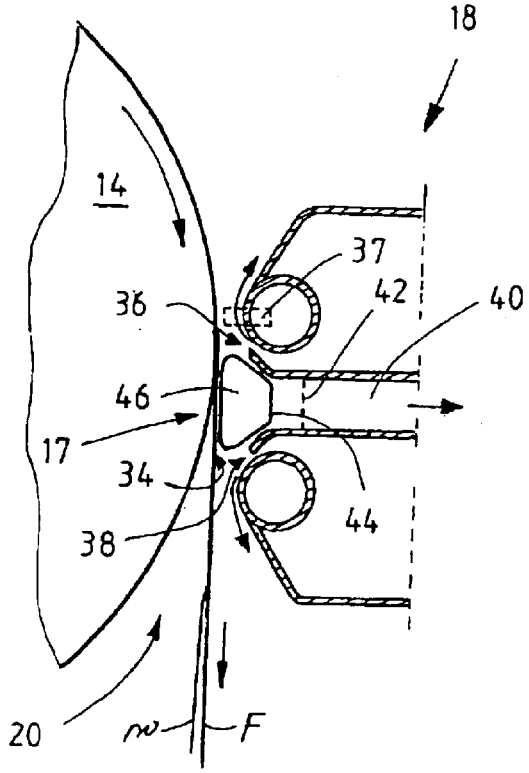

FIG. 3*a* shows a solution for creating an underpressure at the detachment point 17 over the region at the leader which is stronger than over the surrounding region, and for separating this underpressure region from the surrounding region. FIG. 3*a* shows at the detachment point 17 between the wire and the cylinder 14 a part of the underpressure box 18 arranged at the opening gap 20 between the first drying cylinder 14 and the drying wire F conveying the web w. The underpressure box creates an underpressure region 34 with a strong underpressure $p_1$ on that side of the wire which is away from the web, and with this underpressure the web can be kept attached to the wire. The length of the underpressure region 34 in the travel direction of the web is typically 50 to 300 mm, advantageously about 100 to 200 mm. In the case presented in FIG. 3*a* the underpressure is created on one hand

- by ejecting away air from the underpressure region, with the aid of ejection nozzles 36, 38 blowing upwards and downwards, and on the other hand
- by sucking air away from the underpressure region to the suction channel 40 or to the suction opening. A net 42 or the like is arranged in the suction opening in front of the suction channel, in order to prevent paper scraps from being conveyed into the suction channel.

The underpressure can be created simply by ejection, or even only by sucking. If ejection nozzles are not used, then the underpressure region on the input and output sides of the wire must be sealed by other means, for instance with mechanical seals.

The underpressure box can be substantially larger than the one shown in FIG. 3*a*, and it can, as the box 18 shown in FIG. 1, mainly fill the whole pocket between the drying cylinders. Then the extension part of the box, which is not shown in FIG. 3*a*, generally creates a lesser underpressure $p_3$ over the wire than its upper part shown in FIG. 3*a*. An underpressure box of this kind is presented in the applicant's international patent application PCT/FI00/00130.

Figure 3B:
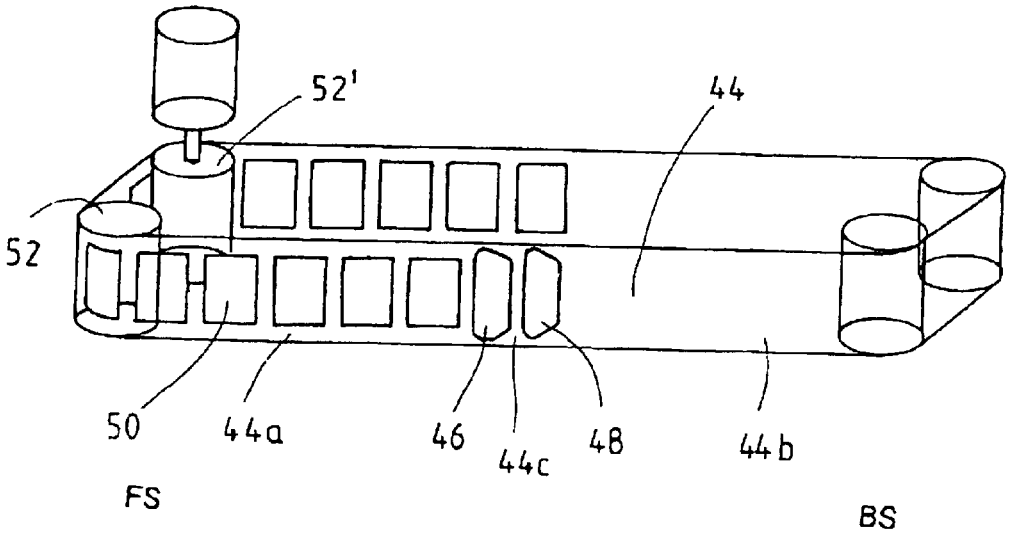

According to the invention the underpressure box of FIG. 3*a* is provided with members, with which the underpressure created by the box can be controlled in the cross direction of the web. These members comprise a band 44, a so called barrier band, which is arranged in front of the suction opening of the suction channel so that it is movable in the cross direction of the web, and which is provided in some parts with openings 50. FIG. 3*b* shows schematically one exemplary shape and arrangement of the holes 50 in the band. Also many other forms of the hole 50 are possible, as are also other arrangements in the band. The width and the height of the band are typically such that as a solid band it can close the suction opening of the suction channel 40 in FIG. 3*a*, and thus it can prevent the suction effect. The band 44 and the members moving it are presented in FIG. 3*b*.

In the case of FIG. 3*b* the band 44 is an endless band loop with a length which is slightly larger than twice the width of the web. Instead of an endless band it would be possible to use a long band, which on both sides of the machine can, as the need arises, either be wound on a roll or wound out from the roll when the band is moved in the machine cross direction.

In FIG. 3*b* the band 44 is arranged to pass in front of the suction opening of the suction channel along the outer surface of the structure of the underpressure box. The band can, when desired, be arranged to travel across the suction channel, for instance on the right side of the net 42 in FIG. 3*a*.

In the case of FIG. 3*b* about half of the band 44*a* is provided with holes 50, whereas the second half 44*b* is without openings, or provided with substantially smaller holes. The band 44 can be moved around the rolls 52. One 52' of the rolls is arranged as a driving roll. In this manner the band can be moved in the machine cross direction, so that a larger or smaller portion of the band 44*a* provided with openings will be in front of the suction opening in FIG. 3*a*.

During a normal run the portion 44*a* of the band provided with holes is typically arranged in front of the whole suction opening, in order to create an unhindered suction effect over the whole region 34. During the web threading the band is moved so that the suction effect is created only over the leader 24. That portion 44*b* of the band which is without holes, or which has substantially less holes than the rest of the band, is moved over the run-down portion of the web, i.e. over the second strip. In this way the underpressure is reduced in that region where the desire is to detach the web from the wire, and to continue its travel on the drying cylinder to the doctor blade. During the spreading phase of the web threading the band 44 is moved, in FIG. 3*b* from the front side to the back side, so that the region under the suction effect increases in accordance with the spreading of the leader. The underpressure is kept strong over the whole spreading leader. The underpressure is kept lesser over the narrowing run-down web. The band is advantageously moved so that during the whole movement the underpressure will change from the pressure $p_1$ to the pressure $p_2$ in the region between the leader and the second strip, i.e. for instance over the third strip or the wide slit.

According to the invention a protection zone is arranged between the underpressure region and the region with the lesser underpressure. The protection zone is created by arranging one or more vertical seals 46, 48, which are located relatively close to each other and which project from the band towards the wire in that portion of the band 44, which will be located between the underpressure region and that region with the lesser underpressure, whereby the seals form a barrier for the air flow between the underpressure regions. The seals 46, 48 can be cut-off plates, brushes or corresponding members, which are made of plastic or other flexible material, and which can be mounted to extend relatively close to the wire. The seals divide the region 34 between the band and the web into portions in the machine cross direction. The seals create a protection zone between different regions, whereby they prevent air from bleeding from a region with a lesser underpressure, or with an overpressure, into the underpressure region.

In a solution according to the invention, in which a third strip is formed between the leader 24 and the second strip 26, seals 46, 48 are arranged in the band typically within an area having approximately the width of the third strip or narrower. The band itself is then arranged in the underpressure box so that the region provided with seals will be located over the third strip, where it forms a protection zone over this region. Then the first seal is advantageously located at the slit between the leader and the third strip, most suitably ±15 cm from the slit. The second seal is advantageously located at the slit between the third strip and the second strip, most suitably ±20 cm from the slit.

The seals 46, 48 form flow barriers in the machine cross direction within the underpressure region. The blows from the ejection blow nozzles seal the underpressure region on the wire input and output sides, i.e. above and under the region 34. In addition conventional edge seals are arranged at the edges of the underpressure box, which are not shown here.

The region 34 between the underpressure box and the web can be divided into two regions with the aid of the protection zones realised by the seals in this way, or into more regions when desired, in which regions the underpressures can be individually controlled. In the case of FIGS. 3*a* and 3*b* the underpressure can be controlled by controlling the suction effect directed into each region. In the case presented by FIG. 3*b* the suction effect is controlled by arranging a suitable portion of the band 44 in front of the suction opening.

In the case shown in FIG. 3*b* the band 44 is provided with large holes 50 in the first portion 44*a* on the machine front side (FS). This first portion 44*a* controls how the underpressure is created in that underpressure region, with the aid of which the leader is kept attached to the wire during web threading and spreading. In the case presented in FIG. 3*b* the band 44 is arranged to be completely without holes in the second portion 44*b* on the machine back side (BS). This second portion 44*b* reduces or prevents the forming of an underpressure in that part of the underpressure region which has an effect directed at the run-down web portion.

Between the seals 46 and 48 there is left a small separate intermediate region where the underpressure is controlled, or it is allowed to settle, to a pressure between the underpressures at the edge regions. This intermediate region is located at the third strip according to the invention. It is not always necessary to use two separate seals in order to define this underpressure region, but it is automatically created around one seal, due to bleeding air flows.

In the solution according to FIG. 3*a* the underpressure is controlled by controlling the suction effect. The underpressure can be controlled to a lower level over the run-down strip, when desired, also by other means, for instance by reducing the effect of the ejection blow nozzle 36, particularly in that area of the underpressure region where the underpressure is directed against the run-down strip. The effect of the ejection blows can be reduced by preventing the ejection blows or interfering with them, for instance with the aid of other opposite blows, or with members 37 which in front of the ejection blows project toward the web and which are shown by dotted lines.

Figure 4A:
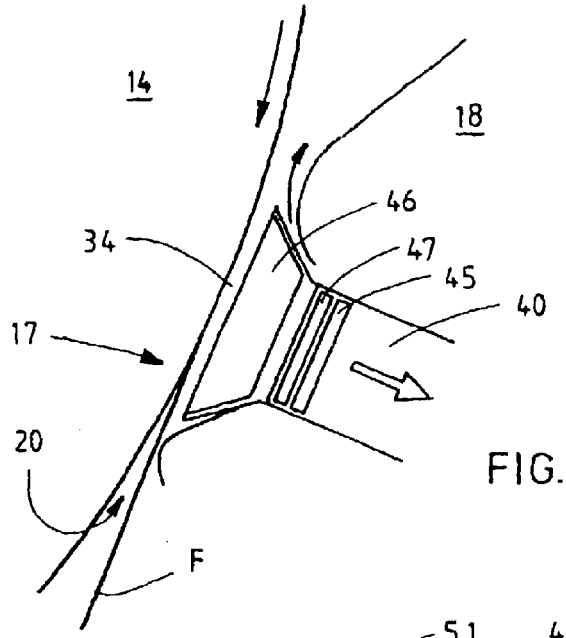
Figure 4B:
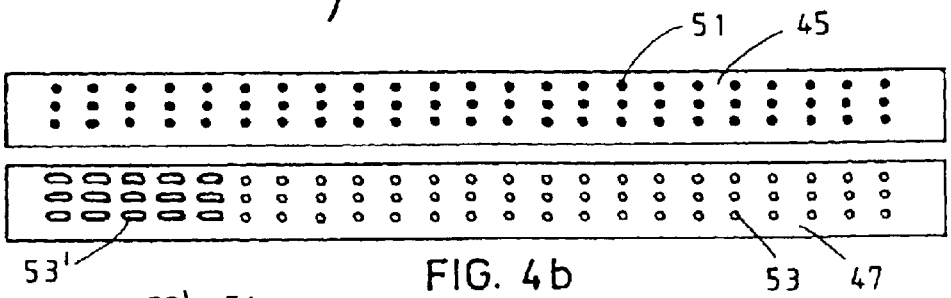

The FIGS. 4*a* to 4*d* show a control member, which differs slightly from the solution shown in FIGS. 3*a* and 3*b*, for controlling the suction at the suction opening of the suction channel 40 in the underpressure box. FIG. 4*a* uses the same reference numerals as in the previous figures, where applicable.

FIG. 4*a* shows a cross-section of the drying cylinder 14 and the wire F at the opening gap 20 in accordance with FIG. 3. An underpressure box 18 with a suction channel 40 is arranged at the detachment point 17. A sealing member 46 is arranged at the suction channel so that it is movable across the machine. In addition two perforated plates are arranged with their side surfaces against each other in the opening of the suction channel, across the channel, so that with these plates, the actual perforated plate 45 and the control plate 47, it is possible to prevent the suction effect of the suction channel in the region 34 either completely or partly. The width and the height of these plates is mainly such that when they are arranged in front of the suction channel they together mainly cover the whole suction channel, whereby air can flow into the suction channel mainly only through the holes in the plates.

Figure 4C:
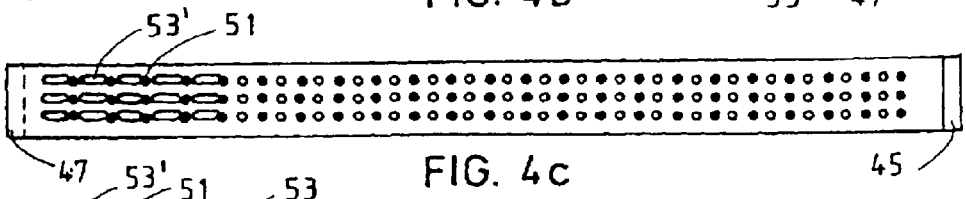
Figure 4D:
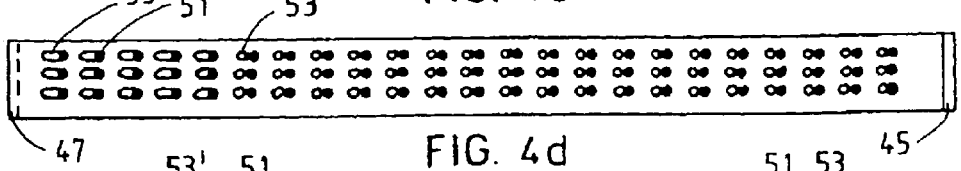
Figure 4E:
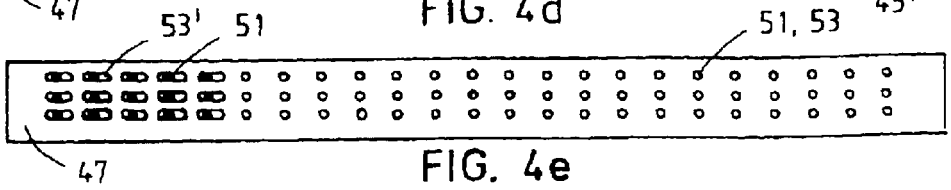

The holes are made in the plates so that air can pass through all holes 51 in the actual perforated plate 45 when the control plate 47 is in a mutual, so called open-position, i.e. when the holes 53 of the control plate and the holes 51 of the perforated plate are over each other, as shown in FIG. 4*e*. Then a suction effect is obtained over the whole underpressure box region in the machine's cross direction.

The control plate can be moved in the machine's cross direction so that the control plate covers all holes 51 in the perforated plate 45, as shown in FIG. 4*c* where all holes 51 in the actual perforated plate are covered by the control plate, and correspondingly all holes 53 in the control plate are covered by the actual perforated plate. Then the whole suction channel 40 is closed, and no suction effect is obtained in the region between the underpressure box and the cylinder.

In the exemplary case shown here the holes 51 formed in the actual perforated plate are round, symmetrical holes of equal size. The main part of the holes in the control plate are also round holes, mainly of the same size as the holes 51. The holes 53' made in the control plate at the front side are oval holes, which are substantially longer than the holes 51, and due to which the plates can be arranged in the position shown in FIG. 4*d*, where only the holes at the front side end are located over each other and allow the air to flow. The holes at the back side end are not located over each other, but they are covered by the respective other plate and thus closed.

When the plates are mutually positioned according to FIG. 4*d*, the underpressure box can thus create a suction effect for instance only at the leader, and thus during the web threading a stronger underpressure in this region than over the space where the run-down web travels.

Figure 5A:
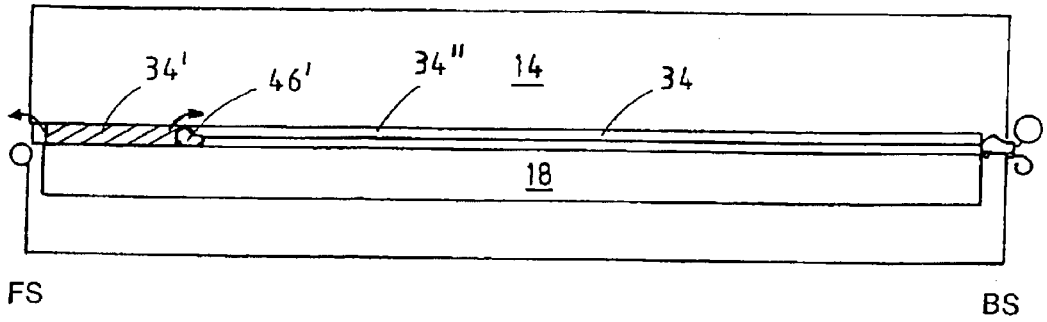

According to the invention it is also possible to arrange a sealing member 46 between the underpressure box 18 and the drying cylinder 14, where the sealing member makes it possible to maintain a stronger underpressure in the region of the leader. FIG. 5*a* shows an underpressure box 18 which in front of the drying cylinder 14 extends across the web, whereby the box is provided with a sealing member 46' which is arranged in the underpressure region 34 between the box and the cylinder to seal a narrow region 34' with a strong underpressure at the front side from the rest of the slight underpressure region 34".

Figure 4F:
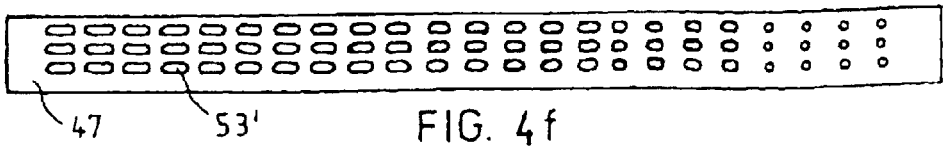
Figure 5B:
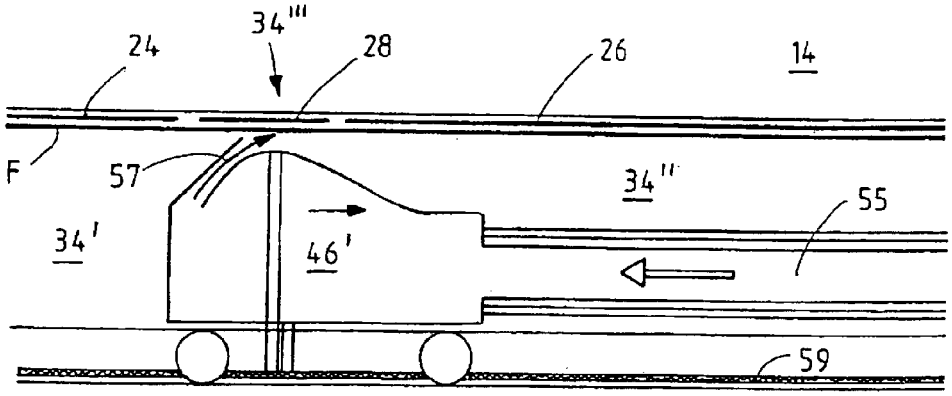

The sealing member 46' comprises a carriage passing across the machine, as shown in the enlargement of FIG. 5*b*, and compressed air can be supplied by the hose 55 to the carriage in order to create sealing ejection blows 57 between the carriage 46' and the wire F. In this way it is possible to maintain a sufficiently strong underpressure $p_1$ over the leader 24 in the region 34', an d to secure that the strip is kept attached to the wire F in the opening nip. The underpressure maintained at the second strip 26, the run-down strip, in the region 34", is not as strong, but a pressure $p_2$ which can be a slight underpressure, a zero pressure or an overpressure. At the region 34'" over the third strip 28 the pressure changes from the pressure $p_1$ to the pressure $p_2$. During the spreading phase of the web threading the carriage 46' can be moved with the aid of the wire 59 towards the back side (BS) according to the spreading of the leader. When the leader has been spread over the whole width of the web, then the plates 45 and 47 of the FIGS. 4*a* to 4*f* arranged in the suction channel in front of the suction opening can be positioned so that all holes are open, i.e. in the position shown in FIG. 4*e*. If the underpressure created by the suction effect is not required, then the plates can be positioned into the position shown in FIG. 4*c*, in which all holes are closed.

The control plate 47 of FIGS. 4*a* to 4*f* can be provided with holes 53' of different lengths, for instance so that the longest holes are located at the end on the front side, and then the holes become gradually shorter when proceeding towards the back side, as shown in FIG. 4*f*. Then at first those holes 51 of the perforated plate 45 are opened which are located at the longest holes in the control plate 47. By moving the control plate it is possible to gradually increase the number of open holes, e.g. in the spreading phase of the web threading, until finally all holes are open in the final phase of the spreading. The holes 51 and 53 in the plates shown in the FIGS. 4*b* to 4*f* are either round or oval holes. The holes in the plates can also have other shapes, if desired, such as rectangular, square or slit-formed holes.

In the solutions according to the FIGS. 3*a*, 3*b*, 4*a* to 4*f* the run-down portion of the web is prevented from following the wire by reducing the underpressure, which during normal run attaches the whole web to the wire and transfers the web onward in the drying section.

Figure 6A:
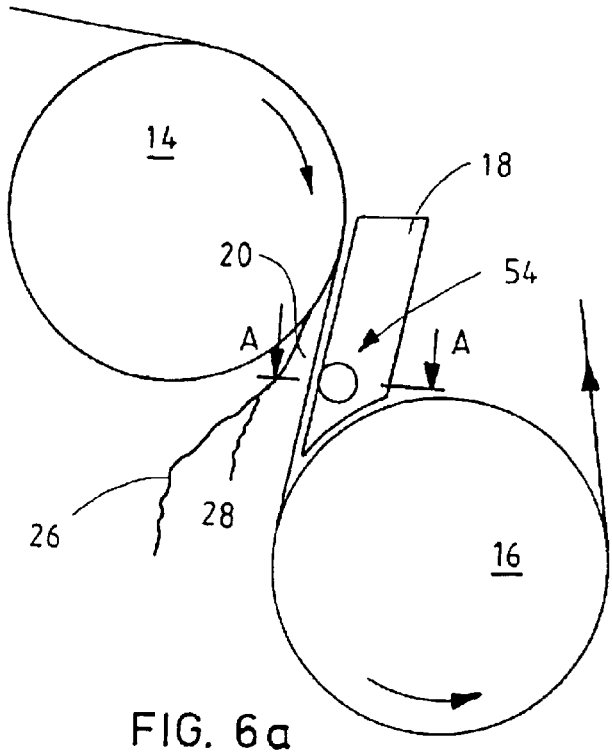
Figure 6B:
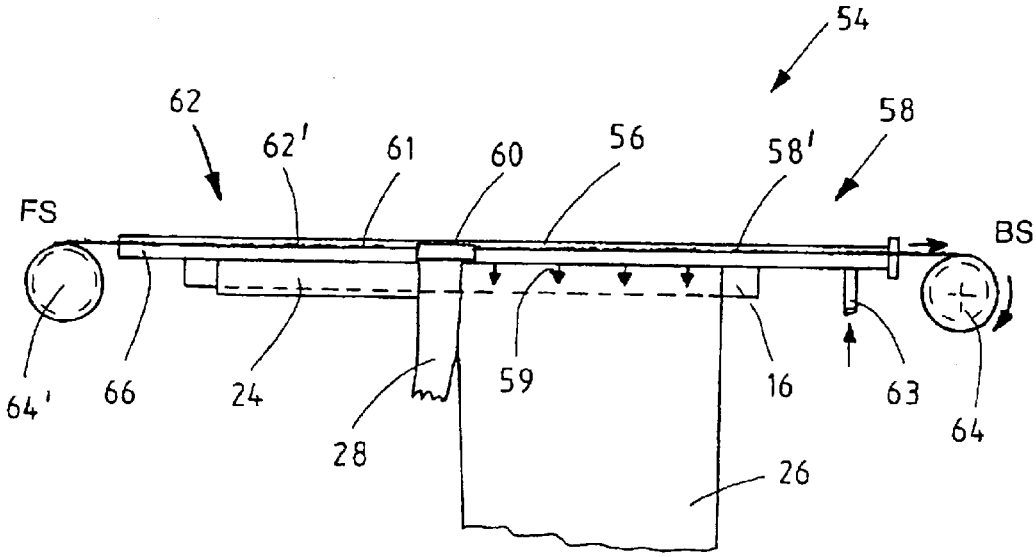

The alternative solution according to the invention presented in FIGS. 6*a* and 6*b* prevents the run-down portion 26 of the web from following the wire F by blowing so called inhibiting blows against the web.

FIG. 6*a* shows, seen from the back side of the machine, an underpressure box 18, which is located at the opening gap 20 between the first drying cylinder 14 and the wire F, and which extends from the gap to the wire roll 16, whereby the members creating the underpressure are not shown in more detail here. Members 54 are arranged at the output side of the box, as seen in the travel direction of the wire, in order to create blows against the run-down portion 26 of the web.

FIG. 6*b*, which is cross-section of the FIG. 6*a* at AA, shows in a view from above the travel of the web in the opening gap 20, whereby the web has been cut for the web threading, and whereby the leader 24 travels to the wire roll 16 and the run-down portion 26 of the web and the intermediate strip 28 are separated from the leader.

As shown in FIG. 6*b*, the members 54 creating the blows comprise a pipe 56 extending over the web, which pipe is arranged in the underpressure box and provided with blow openings, nozzles or the like, whereby the pipe is connected to a compressed air supply 63 at the first end 58 of the pipe, in the case of FIG. 6*b* at the end on the back side (BS).

A slide 60 is arranged in the pipe 56, so that the slide can prevent the passage of the compressed air from the first end 58 of the pipe to the second end 62 of the pipe. Thus the slide 60 divides the pipe into two sections, a first section 58' which is connected to the compressed air supply, and a second section 62' which is not connected to any compressed air supply. The slide can be for instance a bar of metal or plastic, which with the aid of conventional seals is sealed against the inner surface of the pipe, so that it is relatively tight. It is not necessary that the seal between the slide and the pipe's inner surface is absolutely tight.

In the pipe a row of small holes are drilled or made in some other suitable way in the longitudinal direction, typically with a diameter of 3 to 7 mm, e.g. about 5 mm, and typically with a distribution of 40 to 400 mm, e.g. about 300 mm. Compressed air blows are discharged through the holes in the pipe, shown by the small arrows 59, but only from the first section 58' of the pipe. The location of the slide 60 determines the length of the area where the blows are directed against the web.

In the solution shown in FIG. 6*b* the slide 60 is positioned mainly over the third strip 28, i.e. the intermediate strip, so that the blows are mainly directed only against the run-down portion 26 of the web. In this way the run-down portion 26 of the web is detached from the wire and forced to fall down into the pulper or the like located below the machine. No blows are directed against the leader 24, whereby it is allowed to travel onwards into the drying section. A protection zone is created over the third strip, in which zone the blows cease to have any effect. In this way it is possible to secure that the leader is kept attached to the wire. The third strip 28 is removed through a way which is considered most suitable in the case in question.

When the web threading phase has continued to the web spreading phase the slide 60 is moved according to the spreading, i.e. according to the angle cutting of the web, toward the first end 58 of the pipe, until the blows have ceased over the whole width of the web and the web has been transferred in its whole width forward into the drying section. In the solution shown in FIG. 6*b* a wire 61, e.g. a plastic coated wire, is fastened to both ends of the slide 60, whereby the wire has a pulling device 64 at the back side end so that the slide can be pulled in the pipe toward the back side end. At the back side end the pipe is closed by a seal. In connection with the pulling device there is further a reel or drum, on which the wire can be wound. On the other side of the machine, on the front side, there is correspondingly a rewinding device 64' of the wire, with which the slide can be pulled back to the front side when the need for blowing has ended, so that it will wait for the next web threading phase.

At the beginning of the web threading the slide is automatically moved to close the inhibiting blow at the leader 24. In the initial phase the leader is a very narrow strip. FIG. 6*b* shows the web threading phase during web spreading, whereby already a relatively wide section of the web has been transferred to the drying section. At the initial stages of the spreading phase the pulling roll 64 is automatically started, whereby the slide 60 can be moved by the pulling device 64 toward the back side at the same speed at which the angle cutter moves in the machine's cross direction and widens the leader. When a full-width web has been transferred through the drying section, then the blows can be cut off and the slide can be pulled back into the pipe section 66 on the front side, where it waits for the next web threading.

In the case of the FIGS. 6*a* and 6*b* the web threading can, in addition, at the same time be controlled by using the solution shown in the FIGS. 3*a* and/or 4*a–f*. In addition the passage of the web's different strips can be controlled separately by attaching the different strips of the web separately to the wire or to the drying cylinder, or by preventing them from being attached to these, by using wetting, liquid spraying etc. in a way known as such.

Figure 7:
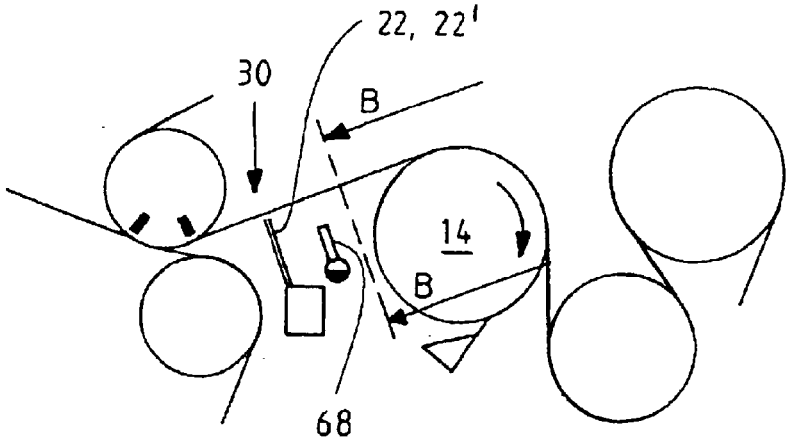
FIG. 7 shows schematically and seen from one side of the drying section the initial stage of a drying cylinder group where the invention is applied, and where a spraying system is arranged in order to aid the run-down of the web.
Figure 8:
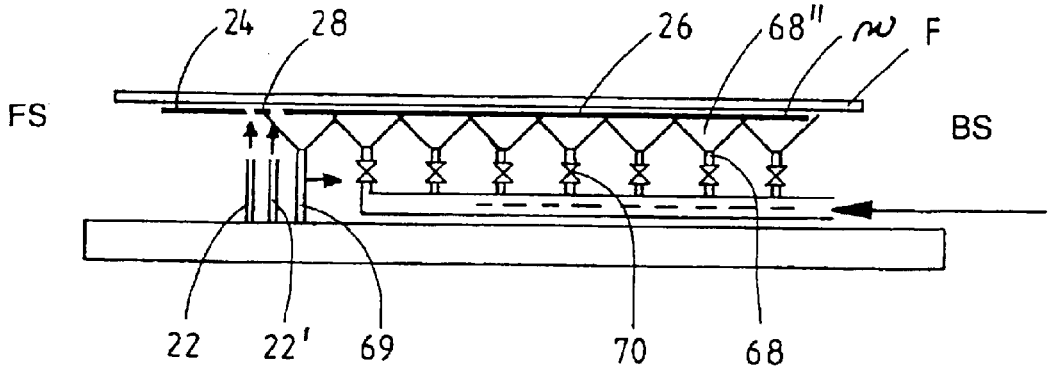
FIG. 8 shows a cross-section according to the line BB in FIG. 7.

The FIGS. 7 and 8 present one such way to prevent the run-down portion of the web from being transferred on its own too early onward into the drying section. In the solution according to FIGS. 7 and 8 the run-down portion of the web, i.e. the second strip 26, is attached to the drying cylinder by spraying water or some suitable substance on it, whereby this second portion will be better attached to the surface of the drying cylinder than the leader. In this way it is possible to get the second strip 26 to travel forward, as it is attached to the surface of the cylinder until it is detached from the cylinder, for instance by a doctor blade.

FIG. 7 shows the beginning of the drying section where two cut squirts 22, 22' are arranged in front of the first drying cylinder 14, whereby the cut squirts cut two slits in the web, in order to form the leader, the run-down strip and the intermediate strip according to the invention. At a short distance from cutting point 30 in the travel direction of the web there is arranged spray tubes 68, which spray liquid jets against the run-down section of the web and the intermediate strip, such as water or some other liquid, which is suitable for the attachment. Water is not sprayed against the leader. In the case of FIG. 1 the run-down section of the web is attached on the drying cylinder 14 by spraying from the nozzles 68' water or some other liquid, which is suitable for the attachment on the cylinder' surface.

FIG. 8 shows the cross-section BB in FIG. 7. The cross-section shows the two cut squirts 22, 22' at the cutting point when the web threading phase is initiated. At the cutting point the web w is cut into a narrow leader 24 on the front side of the cutting point, and an intermediate strip 28 and a run-down strip 26 on the back side of the cutting point. Close to the second cut squirt 22' there is fastened a spraying tube 69, which during the leader spreading phase moves together with the cut squirts towards the machine's back side. This spraying tube sprays liquid directed at the intermediate strip 28 and the edge of the second strip. In addition a row of spraying tubes 68 are arranged on the back side of the cutting point, which tubes 68 direct a liquid spray 68" against the run-down portion 26 of the web w. The spraying tubes 68 are provided with valves 70, with which the spraying can be gradually and automatically stopped during the spreading phase, by shutting first the spraying tubes which are closest to the front side (FS), and in the last stage the spraying tubes which are closest to the back side (BS).

With the solution presented in FIGS. 7 and 8 the run-down portion of the web is glued to the first drying cylinder by spraying a suitable liquid on it, such as water. During the spreading of the web portion which travels into the drying section the valves or the nozzles of the spraying tubes are closed in accordance with the spreading of the web, so that this portion will not be sprayed.

In a second alternative application the run-down web can be attached to the surface of the drying cylinder by wetting the cylinder's surface at suitable points, for instance with a wet sponge. The wetting of the cylinder's surface can be extended mainly over the whole web's region, excepting the region of the leader. During the spreading phase the wetting is terminated in the region of the web, which travels to the drying section, by taking off the wetting sponge from that part of the cylinder's surface which corresponds to the region in question.

In the case of FIGS. 7 and 8 there is presented a solution where the run-down web is attached to the surface of the drying cylinder by spraying it. Correspondingly the leader 24 can be wetted so that it will be better attached to the wire than the rest of the web, or so that it is better detached from the cylinder than the rest of the web, whereby the leader will better than the rest of the web follow the wire onwards into the drying section.

In both cases it is advantageous to create a protection zone between the run-down portion of the web and the leader, i.e. a third strip or the like, which prevents the spraying directed at the run-down portion of the web from reaching the leader in an undesired way, or which prevents the wetting directed at the leader from reaching the run-down portion of the web.

FIGS. 9*a–b* and 10*a–f* present a control member which differs from the solution in the FIGS. 3*a* and 4*a*, in that this control member can control the open area of the suction opening of the suction channel in the underpressure box.

FIG. 9*a* presents a bar 72, which is mounted in front of the suction opening, across the web, and which is partly "bevelled", so that the cross-section of the first end 74 of the bar is a semicircle covering half of the cross-section of the round bar shown by a dotted line, and so that the cross-section of the second end 76 of the bar comprises a 90° arc and a segment formed between the two straight lines extending from the ends of the arc to the axis of the bar. It is conceivable that the bar 72 could be made of a round bar, so that the bar is first split in the longitudinal direction in two equal parts. Then the bar with a semicircular form is tooled on the plane side so that material is removed symmetrically on both sides of the axis, so that the cross-section of the bar is evenly reduced from its first end toward its second end. The angle between the two planar sides of the bar is continuously reduced from the angle $\beta$ of 180° to the angle $\alpha$ of about 90°. Of course the bar can be made into this shape using many different tooling methods known as such.

The bar 72 which is shaped in this way is mounted to be turnable in the direction of the axis, i.e. rotating, in front of the slit-like suction opening 34 of the underpressure box extending across the web, in the manner shown in FIG. 9*b*, whereby the bar can be rotated so that the bar covers the desired part of the suction opening and leaves the desired part 78 open. By rotating the bar it is thus possible to gradually open the suction opening in its longitudinal direction during the spreading of the web. The rotation of the bar and the movement of the cut squirt are made to occur simultaneously.

Figure 10A:
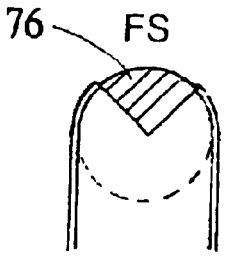
Figure 10D:
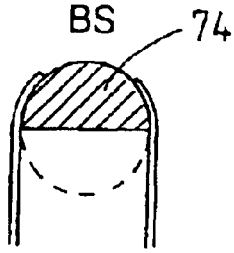
Figure 10B:
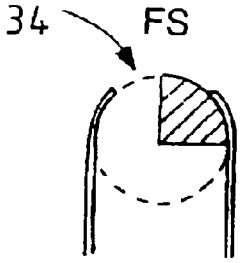
Figure 10E:
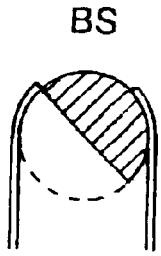
Figure 10C:
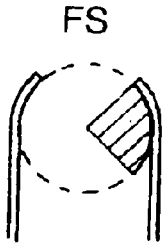
Figure 10F:
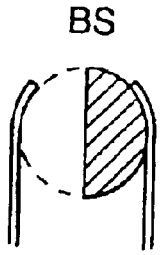

The FIGS. 10*a–c* present cross-sections of the suction opening of an underpressure box where the solution of FIGS. 9*a* and 9*b* is applied, seen from the front side, and in FIGS. 10*d–f* the same seen from the back side, during different running situations.

Thus the FIGS. 10*a* and 10*d* show the cross-section of the suction opening during web threading, whereby the bar 72 is turned in front of the suction opening so that it closes the suction opening mainly over its whole length. The bar can be rotated so that at the front side of the suction opening a short part of the suction opening is opened, corresponding to the width of the leader, even if this is not shown in FIG. 10*a*. FIG. 10*d* shows that the suction opening is completely covered at its end on the back side.

FIGS. 10*b* and 10*e* show the cross-section of the suction opening during the spreading of the web, whereby the suction opening 34 is partly opened on the front side and closed on the back side. This situation corresponds to the situation presented in FIG. 9*b*. FIGS. 10*c* and 10*f* show in a corresponding way the cross-section of the suction opening during a normal running situation, where the suction opening is open over the whole width of the web.

The invention is not intended to be limited to the embodiments presented as examples above, but on the contrary, the object is to be able to apply it widely within the inventive idea defined in the enclosed claims.

The protection zone according to the invention can thus be formed, when required, between the most varying strips to be cut in the web. In addition to the above described leader, the run-down strip and the intermediate strip, it is for instance possible to cut a separate edge strip from the web. Thus the invention can be applied for instance in order to separate this edge strip from the leader.

What is claimed is:

1. A method for web threading in a drying section of a machine, the method comprising a first phase and a second phase;

the first phase comprising:

forming and at least one second strip by cutting a full-width web coming to a cylinder drying group of the drying section, and guiding the leader forward in the drying section from a first drying cylinder of the cylinder drying group where the web can be run down, and the second phase comprising spreading the leader to the width of the full-width web, wherein an underpressure box is arranged at an opening gap between said first drying cylinder and a drying wire, such that the underpressure box is on a side of the drying wire away from the web, whereby the underpressure box is capable of directing an underpressure $p_1$ against the web and the underpressure $p_1$ is controllable in a cross direction of the machine, said underpressure box creates an underpressure region between the leader and the underpressure box, the underpressure region having underpressure $p_1$ at a detachment point located in an area where the drying wire is detached from said first drying cylinder, and the underpressure $p_1$ is sufficient to detach the leader from said first drying cylinder or to aid in making the leader follow the drying wire, and a protection zone is provided between the underpressure region and a region adjacent to the underpressure region, the protection zone having a barrier between the underpressure region and the region adjacent to the underpressure region, the region adjacent to the underpressure region has a pressure $p_2$ that is different from the underpressure $p_1$ and which is an underpressure of lesser magnitude than the underpressure $p_1$, a zero pressure, or an overpressure, in order to maintain the underpressure $p_1$ in the underpressure region.

2. The method according to claim 1, wherein the pressure $p_2$ is such that the at least one second strip can be detached from the wire.

3. The method according to claim 1, wherein during the second phase, the underpressure region is widened in the cross direction of the machine in accordance with the spreading of the leader.

4. The method according to claim 1, wherein the protection zone is created at a third strip formed in the web between the leader and said at least one second strip, whereby the underpressure at the detachment point changes in the protection zone from the underpressure $p_1$ to the pressure $p_2$.

5. The method according to claim 1, wherein the protection zone is created at a slit formed between the leader and said at least one second strip, whereby the underpressure at the detachment point changes over said slit from the underpressure $p_1$ to the pressure $p_2$.

6. The method according to claim 1, wherein an air flow through the protection zone is restricted or prevented by the barrier, and the barrier is formed by sealing members that are movable in the cross direction of the machine.

7. The method according to claim 4, wherein said at least one second strip or said third strip are prevented from following the drying wire by blows directed against said at least one second strip or said third strip after the first drying cylinder or by attaching said at least one second strip or said third strip to the first drying cylinder.

8. An apparatus for web threading in a drying section of a machine, which apparatus comprises a cutter that cuts a leader, and at least one second strip from a full-width web coming to a cylinder drying group, a means for directing the leader from a first drying cylinder of the drying cylinder group onward in the drying section, a means for removing the at least one second strip from the drying section, an underpressure box located at the opening gap between said first drying cylinder and a drying wire, such that the underpressure box is on a side of the drying wire away from the web and arranged at a detachment point located in an area where the drying wire is detached from said first drying cylinder, in order to detach the web from the first drying cylinder, and a means for spreading the leader to a width of the full-width web, wherein an underpressure directed by the underpressure box against the web can be controlled in the cross direction of the machine, so that an underpressure $p_1$ of an underpressure region created by the underpressure box between the leader and underpressure box at the detachment point is stronger than the pressure $p_2$ of at least one second region adjacent to the underpressure region whereby the pressure $p_2$ is lesser in magnitude than the underpressure $p_1$, a zero pressure or an overpressure, and the underpressure $p_1$ is sufficient to detach the leader from the first drying cylinder or to aid the leader in following the drying wire, and wherein the apparatus further comprises a means for forming a protection zone between the underpressure region and said at least one second region adjacent to the underpressure region, whereby the protection zone comprises a barrier between the underpressure region and said at least one second region adjacent to the underpressure region, in order to maintain the underpressure $p_1$ in the underpressure region.

9. The apparatus according to claim 8, wherein the pressure $p_2$ is such that the at least one second strip can be detached from the drying wire.

10. The apparatus according to claim 8, wherein the cutter has at least two cutting members, which are arranged side by side at a short mutual distance, so that there is created from the web a narrow third strip between the leader and said at least one second strip, the third strip defining a width of the protection zone.

11. The apparatus according to claim 10, wherein the cutter has one or more blades, which cut the third strip into fine strips.

12. The apparatus according to claim 8, wherein the cutter has cutting members, which form a slit between the leader and the at least one second strip, and which slit defines a width of the protection zone.

13. The apparatus according to claim 8, wherein the underpressure of the underpressure box is varying at the protection zone, so that the underpressure is reduced from the leader towards the at least one second strip.

14. The apparatus according to claim 10, wherein the apparatus comprises blowing members arranged to prevent the at least one second strip or the third strip from following the drying wire.

15. The apparatus according to claim 10, wherein the apparatus comprises members for spraying water or another suitable liquid against a portion of a surface of the first drying cylinder, to attach the at least one second or the third strip.

16. The apparatus according to claim 8, wherein the apparatus comprises members for spraying water or another suitable liquid against a portion of the web to be attached to a surface of the first drying cylinder, and to come off the drying wire after the first drying cylinder.

17. The apparatus according to claim 8, wherein the apparatus comprises members for wetting the leader to attach the leader to the drying wire.

18. The apparatus according to claim 8, wherein the apparatus comprises a cutter which cuts the leader and at least two run-down strips, one strip on each side of the leader, from the full-width web, the apparatus further comprises members for creating a protection zone on both sides of the underpressure region created at the leader, and during web spreading the members creating the protection zone are movable from a central part of the machine towards a front side or a back side of the machine.

19. The apparatus according to claim 8, wherein the members creating the protection zone are movable in the cross direction of the machine during spreading.

* * * * *